US010058221B2

(12) United States Patent
Larsson et al.

(10) Patent No.: US 10,058,221 B2
(45) Date of Patent: Aug. 28, 2018

(54) DISPENSER

(71) Applicant: SCA Hygiene Products AB, Gothenburg (SE)

(72) Inventors: Bjorn Larsson, Gothenburg (SE); Gunnel Elglund, Gothenburg (SE); Per Moller, Barlange (SE); Lars Thoren, Borlange (SE); David Sahlin, Borlänge (SE)

(73) Assignee: SCA HYGIENE PRODUCTS AB, Gothenburg (SE)

( * ) Notice: Subject to any disclaimer, the term of this patent is extended or adjusted under 35 U.S.C. 154(b) by 11 days.

(21) Appl. No.: 14/438,471

(22) PCT Filed: Oct. 26, 2012

(86) PCT No.: PCT/SE2012/051164

§ 371 (c)(1),
(2) Date: Apr. 24, 2015

(87) PCT Pub. No.: WO2014/065733

PCT Pub. Date: May 1, 2014

(65) Prior Publication Data

US 2015/0282680 A1 Oct. 8, 2015

(51) Int. Cl.

| | |
|---|---|
| ***A47K 10/36*** | (2006.01) |
| ***A47K 10/42*** | (2006.01) |
| ***A47K 10/44*** | (2006.01) |

(52) U.S. Cl.

CPC ..... *A47K 10/36* (2013.01); *A47K 10/422* (2013.01); *A47K 10/44* (2013.01); *A47K 10/3643* (2013.01); *A47K 2010/3681* (2013.01)

(58) Field of Classification Search

CPC .... A47K 10/42; A47K 10/36; A47K 10/3612; A47K 2010/3668; A47K 2010/3681; Y10T 225/393

See application file for complete search history.

(56) References Cited

U.S. PATENT DOCUMENTS

| | | | |
|---|---|---|---|
| 804,307 | A | 11/1905 | Fonda |
| 2,809,082 | A | 10/1957 | Marcuse |

(Continued)

FOREIGN PATENT DOCUMENTS

| | | | |
|---|---|---|---|
| CN | 2527209 | Y | 12/2002 |
| CN | 101080188 | A | 11/2007 |

(Continued)

OTHER PUBLICATIONS

International Search Report (PCT/ISA/210) dated Jun. 18, 2013, by the Swedish Patent Office as the International Searching Authority for International Application No. PCT/SE2012/051164.

(Continued)

*Primary Examiner* — Gene O Crawford
*Assistant Examiner* — Ayodeji T Ojofeitimi
(74) *Attorney, Agent, or Firm* — Buchanan Ingersoll & Rooney PC

(57) ABSTRACT

A dispenser for dispensing at least one web from a stack of web material is disclosed. The dispenser includes a housing arranged to hold a stack of web material. A web path extends in an interior of the housing in a first direction in a first portion of the housing and in a second direction in a second portion of the housing. The housing includes an access opening providing access to the interior of the housing. The web path is accessible along a third direction, in both the first and second portions of the housing, via the access opening.

40 Claims, 4 Drawing Sheets

(56) References Cited

U.S. PATENT DOCUMENTS

| | | | | |
|---|---|---|---|---|
| 2,886,226 | A | 5/1959 | Batlas et al. | |
| 2,974,839 | A | 3/1961 | Batlas et al. | |
| 3,826,548 | A * | 7/1974 | Schnyder | B60N 2/12 312/34.12 |
| 3,877,576 | A | 4/1975 | Kishi et al. | |
| 4,089,378 | A | 5/1978 | Suzuki | |
| 4,288,068 | A | 9/1981 | Hashimoto et al. | |
| 4,494,747 | A | 1/1985 | Graef et al. | |
| 4,516,711 | A | 5/1985 | Barege | |
| 4,614,632 | A | 9/1986 | Kezuka et al. | |
| 4,779,861 | A | 10/1988 | Ozawa et al. | |
| 4,861,013 | A | 8/1989 | Shibata et al. | |
| 5,033,620 | A * | 7/1991 | De Luca | A47K 10/42 206/449 |
| 5,061,232 | A | 10/1991 | Bloch et al. | |
| 5,098,078 | A | 3/1992 | Nakanishi | |
| 5,152,522 | A | 10/1992 | Yamashita | |
| 5,205,454 | A | 4/1993 | Schutz et al. | |
| 5,372,359 | A | 12/1994 | Miura et al. | |
| 5,375,785 | A | 12/1994 | Boone et al. | |
| 5,653,439 | A | 8/1997 | Rider et al. | |
| 5,882,004 | A | 3/1999 | Padget | |
| 5,975,518 | A | 11/1999 | Wakana et al. | |
| 6,070,867 | A | 6/2000 | Tsurumi et al. | |
| 6,186,490 | B1 | 2/2001 | Sugiura et al. | |
| 6,213,346 | B1 * | 4/2001 | Skerrett | A47K 10/42 221/48 |
| 6,311,819 | B1 | 11/2001 | Stromme et al. | |
| 6,520,408 | B1 | 2/2003 | Force et al. | |
| 6,655,679 | B2 | 12/2003 | Boucher et al. | |
| 6,736,466 | B1 * | 5/2004 | Helland | A47K 10/28 312/34.11 |
| 7,144,006 | B2 | 12/2006 | Graef et al. | |
| 7,191,657 | B2 | 3/2007 | Maier et al. | |
| 7,472,802 | B2 * | 1/2009 | van Riel | A47K 10/34 221/155 |
| 8,899,508 | B2 | 12/2014 | Hjort et al. | |
| 2001/0020626 | A1 | 9/2001 | Skerrett et al. | |
| 2002/0033405 | A1 * | 3/2002 | Gergek | A47K 10/36 225/96 |
| 2003/0110915 | A1 | 6/2003 | Kapiloff et al. | |
| 2003/0121970 | A1 | 7/2003 | Force et al. | |
| 2005/0275153 | A1 | 12/2005 | Owa | |
| 2007/0010389 | A1 | 1/2007 | Cutrona et al. | |
| 2007/0236110 | A1 | 10/2007 | Kling | |
| 2008/0121649 | A1 | 5/2008 | Kistner | |
| 2010/0258579 | A1 | 10/2010 | Billman et al. | |
| 2011/0089213 | A1 | 4/2011 | Granger | |
| 2011/0101020 | A1 | 5/2011 | Granger | |
| 2011/0210137 | A1 * | 9/2011 | Kling | A47K 10/36 221/6 |
| 2012/0193463 | A1 | 8/2012 | Newhouse et al. | |
| 2012/0211509 | A1 | 8/2012 | Granger | |
| 2013/0105614 | A1 | 5/2013 | Hjort et al. | |
| 2013/0277492 | A1 | 10/2013 | Granger | |
| 2015/0282678 | A1 | 10/2015 | Larsson et al. | |
| 2015/0282679 | A1 | 10/2015 | Larsson et al. | |
| 2015/0297042 | A1 | 10/2015 | Larsson et al. | |

FOREIGN PATENT DOCUMENTS

| | | | |
|---|---|---|---|
| CN | 102395307 | A | 3/2012 |
| CN | 202173351 | U | 3/2012 |
| EP | 0 236 709 | A1 | 9/1987 |
| EP | 0 392 696 | A1 | 10/1990 |
| FR | 853284 | | 4/1939 |
| GB | 2 433 248 | | 6/2007 |
| JP | 2011-194125 | A | 10/2011 |
| WO | 2004/056250 | A1 | 7/2004 |
| WO | 2006/071148 | A1 | 7/2006 |
| WO | 2007/000153 | A1 | 1/2007 |
| WO | WO 2008/009760 | A2 | 1/2008 |
| WO | 2008/078168 | A2 | 7/2008 |
| WO | WO 2011/045493 | A1 | 4/2011 |
| WO | 2011/149393 | A1 | 12/2011 |
| WO | WO 2012/003867 | A1 | 1/2012 |
| WO | 2012/076776 | A1 | 6/2012 |
| WO | 2013/184049 | A1 | 12/2013 |

OTHER PUBLICATIONS

Written Opinion (PCT/ISA/237) dated Jun. 18, 2015, by the Swedish Patent Office as the International Searching Authority for International Application No. PCT/SE2012/051164.

Written Opinion of the International Preliminary Examining Authority (PCT/IPEA/408) dated Oct. 22, 2014, by the Swedish Patent Office as the International Searching Authority for International Application No. PCT/SE2012/051164.

International Preliminary Report on Patentability (PCT/IPEA/409 dated Aug. 22, 2014, by the Swedish Patent Office as the International Searching Authority for International Application No. PCT/SE2012/051164.

European Patent Office dated Aug. 22, 2014.

The extended European Search Report dated Jun. 29, 2016, by the European Patent Office in corresponding European Patent Application No. 12886996.3-1601 (7 pages).

PCT Demand (Form PCT/IPEA/401) dated Mar. 11, 2014, by the Swedish Patent Office as the International Preliminary Examining Authority for International Application No. PCT/SE2012/051158. (7 pages).

International Preliminary Report on Patentability (Form PCT/IPEA/409) dated Jan. 29, 2015, by the Swedish Patent Office in corresponding International Application No. PCT/SE2012/051158. (6 pages).

Written Opinion of the International Preliminary Examining Authority (Form PCT/IPEA/408) dated Nov. 10, 2014, by the Swedish Patent Office in corresponding International Application No. PCT/SE2012/051158. (6 pages).

International Search Report (Form PCT/ISA/210) and the Written Opinion (Form PCT/ISA/237) dated Jul. 1, 2013, by the Swedish Patent Office acting as the International Searching Authority in corresponding International Application No. PCT/SE2012/051158. (10 pages).

Notification of Transmittal of the International Search Report (Forms PCT/ISA/220 and PCT/ISA 210) and the Written Opinion of the International Searching Authority (Form PCT/ISA/237) dated Jul. 8, 2013, by the Swedish Patent Office as the International Searching Authority for International Application No. PCT/5E2012/051160. (10 pages).

An English Translation of the Office Action (Decision on Grant) dated Apr. 28, 2016, by the Federal Service for Intellectual Property Office in corresponding Russian Patent Application No. 2015119664/12. (6 pages).

The extended European Search Report dated May 6, 2016, by the European Patent Office in corresponding European Patent Application No. 12887301.5-1601. (8 pages).

The extended European Search Report dated Jun. 29, 2016, by the European Patent Office in European Patent Application No. 13848737.6-1601. (8 pages).

The extended European Search Report dated May 6, 2016, by the European Patent Office in European Patent Application No. 12887211.6-1601. (9 pages).

English language translation of Office Action/Search Report dated May 17, 2016, by the Russian Patent Office in corresponding Russian Patent Application No. 2015119242. (9 pages).

International Preliminary Report on Patentability (Form PCT/IPEA/409) dated Oct. 1, 2014, by the Swedish Patent Office in corresponding International Application No. PCT/SE2013/050204. (9 pages).

International Search Report (Form PCT/ISA/210) and the Written Opinion (Form PCT/ISA/237) dated Dec. 2, 2013, by the Swedish Patent Office acting as the International Searching Authority in corresponding International Application No. PCT/SE2013/050204. (10 pages).

(56) References Cited

OTHER PUBLICATIONS

PCT Demand (Form PCT/IPEA/401) dated Mar. 31, 2014, by the Swedish Patent Office as the International Preliminary Examining Authority for International Application No. PCT/SE2013/050204. (15 pages).
Office Action (Notification of the First Office Action) dated Sep. 19, 2016, by the state intellectual property office (SIPO) of the People's Republic of China in corresponding Chinese Patent Application No. 201280076556.8, and an English Translation of the Office Action. (9 pages).
Office Action (Notification of the second Office Action) dated Apr. 10, 2017, by the State Intellectual Property Office (SIPO) of the People's Republic of China in corresponding Chinese Patent Application No. 201280076596.2, and an English Translation of the Office Action. (21 pages).
Office Action (Notification of the second Office Action) dated May 10, 2017, by the State Intellectual Property Office (SIPO) of the People's Republic of China in Chinese Patent Application No. 201280076557.2, and an English Translation of the Office Action. (20 pages).
Office Action (Notification of the First Office Action) dated Sep. 20, 2016, by the State Intellectual Property Office (SIPO) of the Peoples Republic of China in corresponding Chinese Patent Application No. 201280076596.2, and an English Translation of the Office Action. (19 pages).
Office Action (Communication pursuant to Article 94(3) EPC) dated Oct. 2, 2017, by the European Patent Office in the European Patent Application No. 12 887 301.5-1601. (5 pages).
Office Action (Notification of the third Office Action) dated Aug. 21, 2017, by the State Intellectual Property Office (SIPO) of the People's Republic of China in corresponding Chinese Patent Application No. 201280076596.2, and an English Translation of the Office Action. (21 pages).
Office Action (Communication pursuant to Article 94(3) EPC) dated Sep. 4, 2017, by the European Patent office in the European Patent Application No. 12 887 211.6-1601. (5 pages).
Office Action (Notification of the 4th Office Action) dated Apr. 16, 2018, by the State Intellectual Property Office of the People's Republic of China in corresponding Chinese Patent Application No. 201280076596.2, and an English Translation of the Office Action. (17 pages).

* cited by examiner

DISPENSER

TECHNICAL FIELD

The present invention relates to a dispenser for dispensing a web from a stack of web material.

BACKGROUND

US 2011/0101020 describes with reference to its FIG. 1, a dispenser for a stack of wipe material according to FR 08.53284. During dispensing of the wipe material the wipe material extends along a web path. The web path extends upwardly from the stack and passes an upper part of a front wall inside the dispenser to extend in a downwardly direction. The upwardly and downwardly directions are directed in substantially opposite directions. In order to load the dispenser with a stack of wipe material, a front cover of the dispenser is opened. The stack is placed inside the dispenser from above and a tail of the wipe material from the stack is placed along the web path by being pulled upwardly over the front wall and thereafter downwardly towards a dispensing opening. An attendant has to reach over the front wall into the dispenser to grasp the tail of the wipe material.

Furthermore, US 2011/0101020 discloses a dispenser comprising a housing with a back plate and a cover. A support-container holds a stack of wipe material which is in use and can hold a spare stack. During dispensing of the wipe material the wipe material extends along a web path. Again, the web path extends upwardly from the stack and passes an upper part of a front wall inside the dispenser to extend in a downwardly direction. The upwardly and downwardly directions are directed in substantially opposite directions. To load the spare stack, the support-container is articulated downwards around an axis of rotation to expose an inside of the dispenser.

There exists a need for an alternative approach for placing a tail of a web material along a web path of a dispenser for a stack of web material.

SUMMARY

An object of the present invention is to provide a dispenser for a stack of web material, in which dispenser a tail of a web material from the stack of material is easily placed along a web path in an interior of the dispenser.

According to an aspect of the invention, the object is achieved by a dispenser for dispensing at least one web from a stack of web material. The dispenser comprises: a housing arranged to hold a stack of web material, wherein a web path extends in an interior of the housing from a stack position to a dispensing opening of the dispenser, the web path extending in a first direction in a first portion of the housing and in a second direction in a second portion of the housing, the first and second directions being directed in substantially opposite directions. The housing comprises an access opening in a first side portion of the housing. The access opening provides access to the interior of the housing. The web path is accessible along a third direction, in both the first and second portions of the housing, via the access opening.

Since e.g. an attendant can reach the web material in both the first portion and the second portion of the housing via the access opening, placing or threading a tail of the web material along the web path is easily achieved. Moreover, since the attendant reaches both the first and second portion along the third direction, the attendant is not hindered by obstacles along the third direction when placing or threading the web material along the web path. As a result, the above mentioned object is achieved.

According to a further aspect of the invention the object is achieved by a dispenser for dispensing at least one web from a stack of web material. The dispenser comprises: a housing arranged to hold a stack of web material, wherein a web path extends in an interior of the housing from a stack position to a dispensing opening of the dispenser, the web path extending in a first direction in a first portion of the housing and in a second direction in a second portion of the housing, the first and second directions being directed in substantially opposite directions. The housing comprises an access opening in a first side portion of the housing, the access opening providing access to the interior of the housing. The web path is accessible at a level defined between a first support element for the web material and a second support element for the web material, in both the first and second portions of the housing, via the access opening.

Since e.g. an attendant can reach the web material in both the first portion and the second portion of the housing via the access opening, placing or threading a tail of the web material along the web path is easily achieved. Moreover, since the attendant can reach both the first and second portions at the level defined between the first support element and the second support element, the attendant is not hindered by obstacles at this level when placing or threading the web material along the web path. As a result, the above mentioned object is achieved.

The web material may comprise a continuous web of tissue paper or nonwoven. Dispensed web from the dispenser may be used as towels, napkins, for general wiping, etc. The web material is Z-folded in an accordion-like manner to form a stack of web material. The web material may comprise one or more web layers. In the case of more than one web layer, the layers are interfolded in the stack. The web material may be separated into sheets of web when web is dispensed from the dispenser. For this purpose the web material may be provided with lines of weakness, perforations. Alternatively, the dispenser may be provided with a cutting arrangement or tearing arrangement for separating a sheet from the tail of web material. A stack of web material is arranged to be placed in the stack position inside the dispenser. The tail of the web material is arranged to extend from the stack position to the dispensing opening of the dispenser, inter alia in the first and second portions of the housing along the first and second directions, respectively. The first and second directions being directed in substantially opposite directions encompass directions which are not entirely parallel, or which are only parallel in one plane. The first and second directions may be directed in two opposite directions substantially along an axis, e.g. an axis extending in a direction in which the stack of web material extends inside the housing.

The dispenser may be a standalone unit or may be mounted to a structure such as a wall, a piece of furniture, or a door. The dispenser may be arranged for manual dispensing of web through a dispensing opening of the dispenser by a user pulling on the tail of the web material. The dispenser may be arranged for automatic dispensing of web through a dispensing opening. The automatic dispensing may comprise electrically powered feeding of web material or a mechanical feeding of web material. In the both cases a user may actuate the feeding.

According to embodiments, the third direction may be substantially perpendicular to at least one of the first and second directions. In this manner an attendant easily may reach the first and second portions of the housing along the third direction.

According to embodiments, the web path may be accessible at a level defined between a first support element for the web material and a second support element for the web material, in both the first and second portions of the housing, via the access opening.

According to embodiments, the first direction may extend from the stack position to the first support element, and the second direction may extend from the first support element to the second support element.

According to embodiments, the housing may comprise a door arranged to open and close the access opening. In this manner an attendant may open the door to access the access opening and the interior of the housing, e.g. for replenishing the dispenser with a stack of web material and/or for threading a tail of web material along the web path.

According to embodiments, the dispensing opening may be arranged in the door. In this manner the door may form at least part of a surface of the housing direct towards a user dispensing sheets of web from the dispenser.

According to embodiments, the first portion of the housing, seen in a direction from the access opening, may be arranged after the second portion of the housing.

According to embodiments, the first portion of the housing may be arranged adjacent to a first wall of the housing, the first wall being arranged opposite to the access opening. The first wall may be a rear wall of the dispenser and an attendant may reach from the access opening towards the rear wall into the dispenser via the access opening.

According to embodiments, the second portion of the housing may be arranged adjacent to the access opening.

According to embodiments, the web path may extend over the first support element. In this manner the web path may be directed from one direction into another direction by extending over the first support element, e.g. from the first direction to second direction.

According to embodiments, a guiding element may be pivotably arranged inside the housing and arranged to pivot towards the first support element. In this manner a nip may be formed by the first support element and the guiding element. In user of the dispenser, a tail of the web material passing over the first support element may thus be held between the first support element and the guiding element to maintain the tail of the web material along the web path inside the dispenser.

According to embodiments, the guiding element may extend substantially from the first wall of the dispenser to the first support element. In this manner an attendant threading a tail of web material from a stack of web material along the web path and over the first support element may be guided between the guiding element and the first support element.

According to embodiments, the second support element may comprise a separation unit adapted for separating a sheet of web from a tail of a web material coming from a stack of web material. In this manner a user may dispense separate sheets of web from the dispenser. The separation unit may be adapted for separating a sheet of web from a perforated web material. Alternatively the separation unit may be adapted for separating a sheet of web from a non-perforated web material.

According to embodiments, the separation unit may comprise a first roller having a first rotation axis and a second roller having a second rotation axis, the first and second rotation axes extending in parallel with each other. In this manner a passage for web material may be formed between the first and second rollers. The passage may form a nip. The separation unit may comprise further rollers, along or between which the web material may pass.

According to embodiments, the first and second rollers may be provided with protrusion elements being spaced along the first and second rotation axes, and wherein outer portions of the protrusion elements on the first roller may overlap partially with outer portions of the protrusion elements on the second roller with a radial overlap length forming an undulated passage for a web material between the first and second rollers. In such an undulated passage, the first and second rollers may engage frictionally with the web material passing there through. Thus, the undulated passage may form a friction nip. Due to the frictional engagement of the web material, a sheet of web may be separated from the tail of web material in the separation unit along a perforation of the web material as a user pulls on the web material to dispense a sheet of web.

According to embodiments, the radial overlap length may be between 2-40 mm, preferably 2-20 mm, more preferably 3-12 mm, or most preferably between 4-10 mm. In this manner an undulated passage suited for breaking the web material along a perforation may be achieved.

According to embodiments, each protrusion element may have a widest width in parallel with the first and second axes within the overlap length. A sum of the widest width of all protrusion elements on one of the first roller or second roller may be between 5-30%, preferably 12-20%, of a web width of that roller. In this manner an undulated passage suited for breaking the web material along a perforation may be achieved. A web width of a roller is a portion of the roller extending along a width direction of the roller. The web width is a width corresponding to a width of a web material arranged to pass over the roller during dispensing of the web material from the dispenser. Put differently, the web width corresponds to the width of the web material passing over the relevant roller.

According to embodiments, the first support element may comprise a third roller pivotably suspended inside the housing. In this manner the web material may be led smoothly over the first support element.

According to embodiments, the dispenser may comprise a stack of web material arranged in the stack position inside the dispenser. In this manner web material for dispensing may be provided in the dispenser. The web material may be a perforated web material.

According to embodiments, the web material may comprise a first web layer divided into sheet products defined between longitudinally separated lines of weakness extending across the first web layer. In this manner a perforated one layer web material may be provided.

According to embodiments, the web material may comprise at least a second web layer divided into sheet products defined between longitudinally separated lines of weakness extending across the second web layer, and wherein the first and second web layers are interfolded so that the lines of weakness of the first web layer are offset from the lines of weakness of the second web layer in a longitudinal direction of the first web layer. In this manner a web material comprising at least two perforated web layers may be provided. Due to the offset lines of weakness of the at least two web layers, alternate dispensing of sheets of web from the first and second layers is achieved.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein.

Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Figure 1:
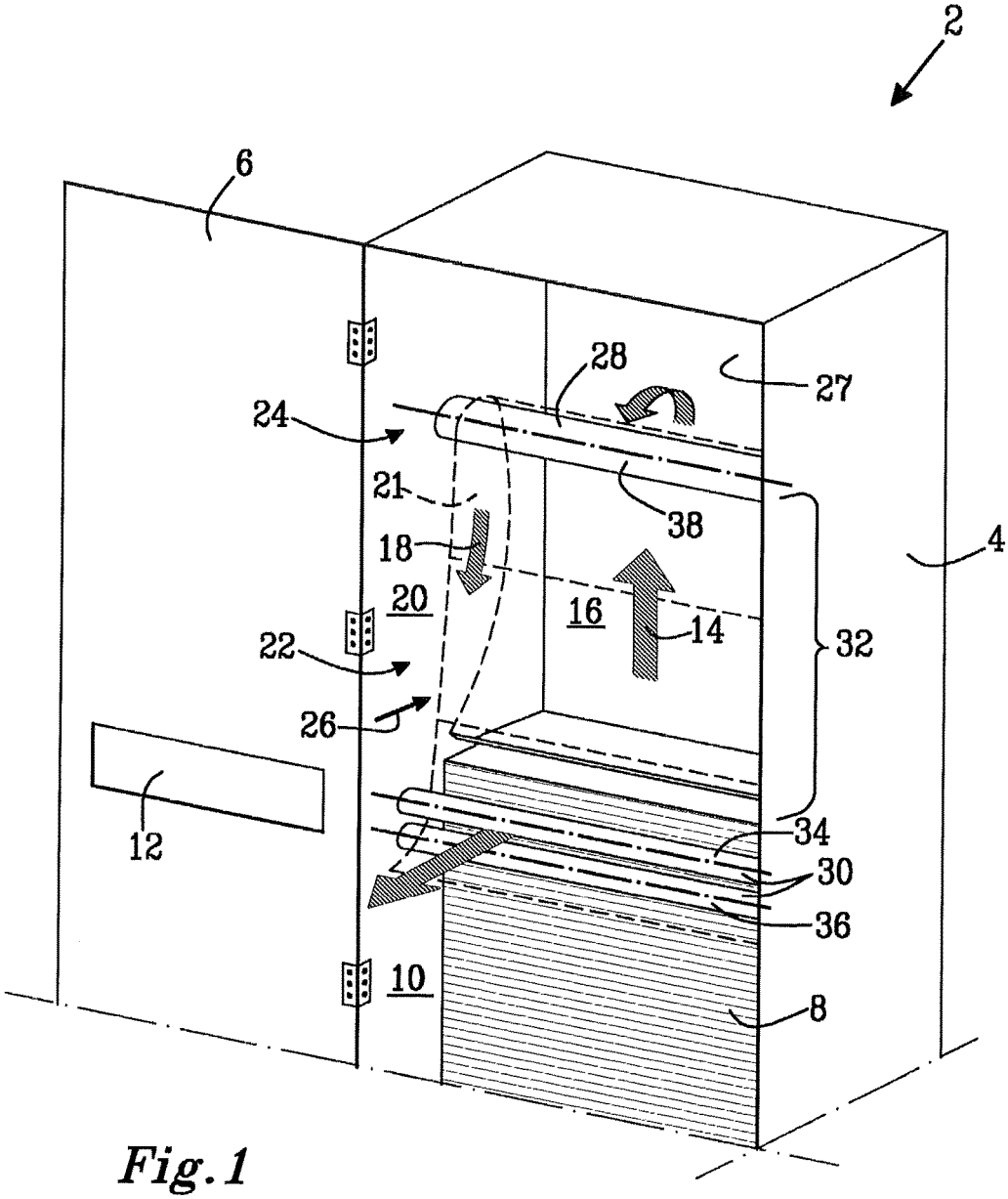
FIG. 1 illustrates a dispenser according to embodiments.

FIG. 1 illustrates a dispenser 2 according to embodiments. The dispenser 2 comprises a housing 4, which housing 4 comprises a door 6. The door 6 is illustrated in an open position to reveal an interior of the housing 4. The dispenser 2 is arranged for dispensing web from a stack 8 of web material. Accordingly, the housing 4 is arranged to hold the stack 8 of web material. The stack 8 comprises continuous web material which is Z-folded in an accordion-like manner. The web material comprise a first web layer, which may be divided into sheet products defined between longitudinally separated lines of weakness extending across the first web layer.

In an interior of the housing 4, a web path extends from a stack position 10 to a dispensing opening 12 of the dispenser 2. The stack position 10 in the housing 4 is a portion of the housing 4 adapted to hold the stack 8 of web material. Accordingly, the stack position 10 extends over the portion adapted to hold the stack 8, from the top of the stack 8 when the dispenser 2 has been newly replenished with web material, as illustrated in FIG. 1, to a stack supporting lower surface inside the housing 4 when nearly all the web material has been dispensed from the stack 8. The dispensing opening 12 is arranged in the door 6 of the housing 4.

The web path extends in a first direction 14 in a first portion 16 of the housing 4 and in a second direction 18 in a second portion 20 of the housing 4. The first direction 14 is directed substantially opposite to the second direction 18. The web path has been illustrated with broad arrows, and a tail 21 of the web material extending along the web path has been illustrated with broken lines, in FIG. 1.

The housing 4 comprises an access opening 22 in a first side portion 24 of the housing 4. The access opening 22 provides access to the interior of the housing 4. The door 6 is arranged to open and close the access opening 22. The web path is accessible along a third direction 26, in both the first and second portions 16, 20 of the housing 4, via the access opening 22. Thus, an attendant may open the door 6 to access the access opening 22 and the interior of the housing 4, e.g. for replenishing the dispenser 2 with a stack 8 of web material and/or for threading the tail 21 of web material from the stack position 10 along the web path to the dispensing opening 12. The third direction 26 is substantially perpendicular to the first and second directions 14, 18.

Seen in a direction from the access opening 22, i.e. in the third direction 26, the first portion 16 of the housing 4 is arranged after the second portion 20 of the housing 4. The first portion 16 of the housing 4 is arranged adjacent to a first wall 27 of the housing 4. The first wall 27 is arranged opposite to the access opening 22. The second portion 20 of the housing 4 is arranged adjacent to the access opening 22.

The dispenser 2 comprises a first support element 28 for the web material and a second support element 30 for the web material. Part of the web path extends between the first and second support elements 28, 30 and over the first support element 28. The first direction 14 extends from the stack position 10 to the first support element 28, and the second direction 18 extends from the first support element 28 to the second support element 30. The web path is accessible at a level 32 defined between the first support element 28 and the second support element 30, in both the first and second portions 16, 20 of the housing 4, via the access opening 22.

The second support element 30 comprises a first roller 34 and a second roller 36. A passage for the web material is formed between the first and second rollers 34, 36. The second support element 30, with its first and second rollers 34, 36, may form a separation unit for separating a sheet of web from the tail 21 of the web material. The first support element 28 comprises a third roller 38. The first, second, and third rollers 34, 36, 38 are pivotably suspended in the housing 4. They may be directly, or indirectly, suspended in the housing 4.

Figure 2:
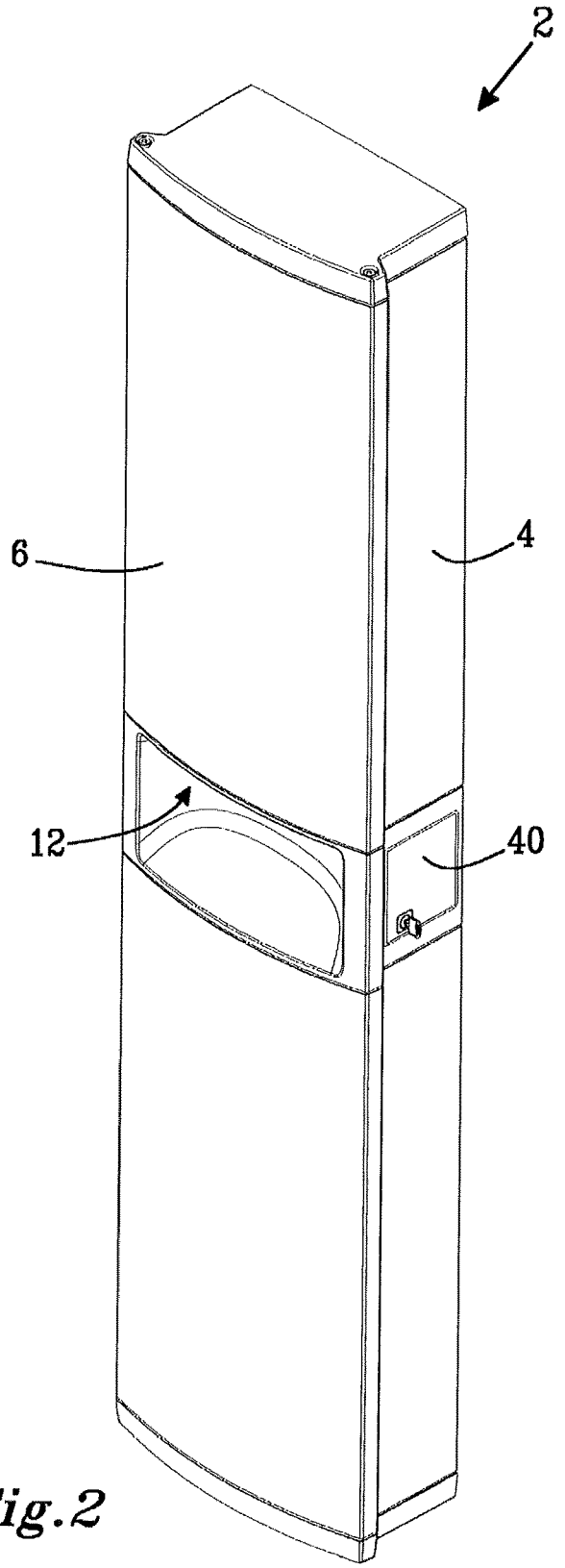
FIG. 2 illustrates a dispenser for dispensing web according to embodiments.

FIG. 2 illustrates a dispenser 2 for dispensing web according to embodiments. The dispenser 2 comprises a housing 4, and the housing 4 comprises a door 6. In the door 6, a dispensing opening 12 is provided for dispensing the web. The door 6 is arranged for opening and closing an access opening to an interior of the dispenser 2. The door 6 may be locked in a closed position by means of a locking arrangement 40.

Figure 3:
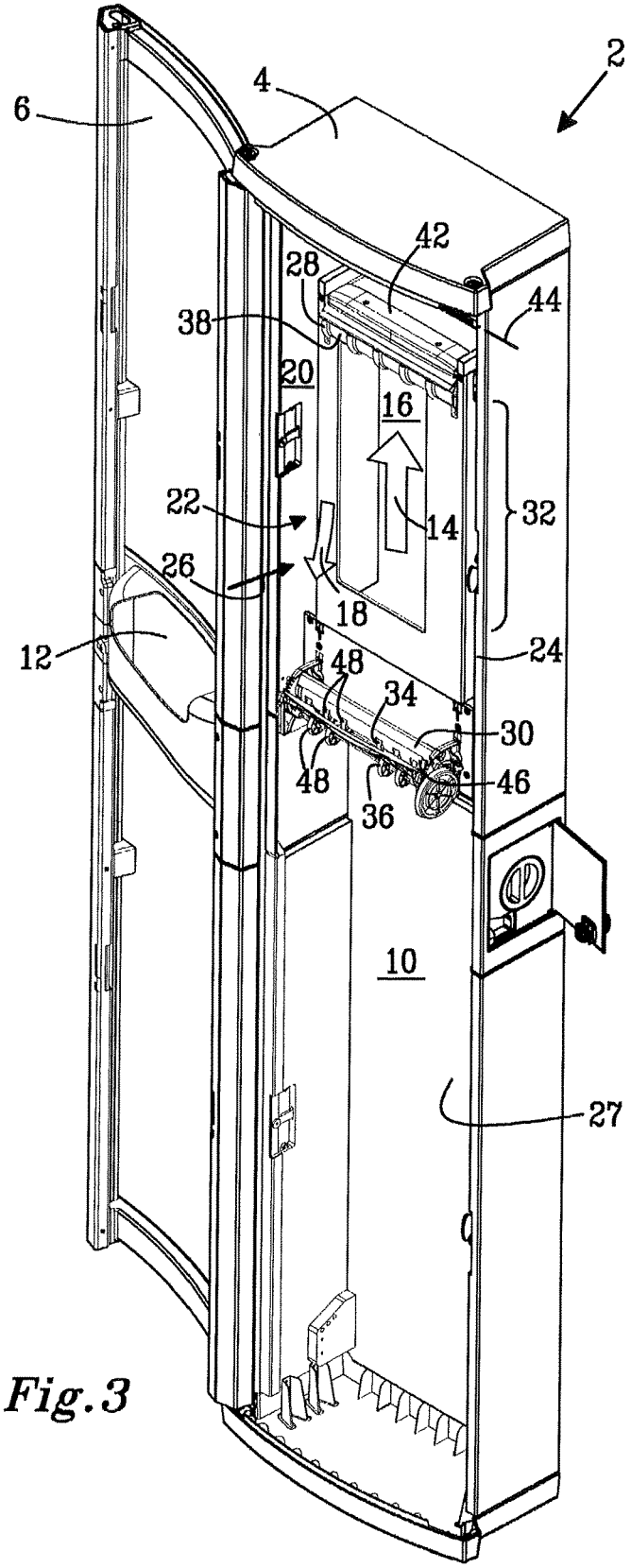
FIG. 3 illustrates the dispenser of FIG. 2 with a door in an open position.

FIG. 3 illustrates the dispenser 2 of FIG. 2 with the door 6 in an open position. Again, the dispenser 2 is arranged for dispensing web from a stack of continuous web material which may be Z-folded in an accordion-like manner. The stack has been omitted in FIG. 3 for clarity reasons. However, from a stack position 10 a web path extends to the dispensing opening 12 of the dispenser 2. The stack position 10 is arranged in a lower portion of the housing 4.

Again, the web path extends in a first direction 14 in a first portion 16 of the housing 4 and in a second direction 18 in a second portion 20 of the housing 4. The first direction 14 is substantially opposite to the second direction 18. The housing 4 comprises an access opening 22 in a first side portion 24 of the housing 4. The access opening 22 provides access to the interior of the housing 4. The web path is accessible along a third direction 26, in both the first and second portions 16, 20 of the housing 4, via the access opening 22. The dispenser 2 comprises a first support element 28 for the web material and a second support element 30 for the web material. The first direction 14 extends from the stack position 10 to the first support element 28, and the second direction 18 extends from the first support element 28 to the second support element 30. The web path is accessible at a level 32 defined between the first support element 28 and the second support element 30, in both the first and second portions 16, 20 of the housing 4, via the access opening 22.

A guiding element 42 is pivotably arranged inside the housing 4 and arranged to pivot towards the first support element 28 about a pivot axis 44. When no web material extends along the web path, the guiding element 42 abuts against the first support element 28. The guiding element 42 extends substantially from a first wall 27 of the dispenser 2 to the first support element 28. The first wall 27 is arranged opposite to the access opening 22. The first axis 44 extends along the first wall 27. A nip formed by the first support element 28 and the guiding element 42 may hold a tail of the web material and prevent the tail of the web material from sliding backwards towards the stack position 10. The guiding element 42 is arranged to pivot towards the first support element 28 from above, and since the first support element extends from the first wall 27 to the first support element 28, it may be ensured that an attendant threads a tail of web material from the stack position 10 over the first support element 28 and under the guiding element 42, i.e. through the nip formed therebetween. The first support element 28 comprises a third roller 38 pivotably suspended inside the housing 4.

The second support element 30 comprises a separation unit 46 adapted for separating a sheet of web from a tail of a web material coming from a stack of web material inside the dispenser 2. The separation unit 46 is adapted for separating a sheet of web from a perforated web material. The separation unit 46 comprises a first roller 34 having a first rotation axis and a second roller 36 having a second rotation axis. The first and second rotation axes extend in parallel with each other. A passage is formed between the first and second rollers 34, 36. The first and second rollers 34, 36 are provided with protrusion elements 48 being spaced along the first and second rotation axes. Outer portions of the protrusion elements 48 on the first roller 34 overlap partially with outer portions of the protrusion elements 48 on the second roller 36 with a radial overlap length forming an undulated passage for a web material between the first and second rollers 34, 36. The radial overlap length may be between 2-40 mm, preferably 2-20 mm, more preferably 3-12 mm, or most preferably between 4-10 mm.

Each protrusion element 48 has a widest width in parallel with the first and second axes within the overlap length. A sum of the widest width of all protrusion elements 48 on one of the first roller 34 or the second roller 36 is between 5-30%, preferably 12-20%, of a web width of the relevant roller 34, 36. The web width is the width of the web material passing over the relevant roller. The undulated passage forms a friction nip, in which the first and second rollers 34, 36 engage frictionally with the web material passing there through. Due to the frictional engagement of the web material, a sheet of web may be separated from the tail of web material in the separation unit 46 along a perforation of the web material as a user pulls on the web material to dispense a sheet of web.

Figure 4:
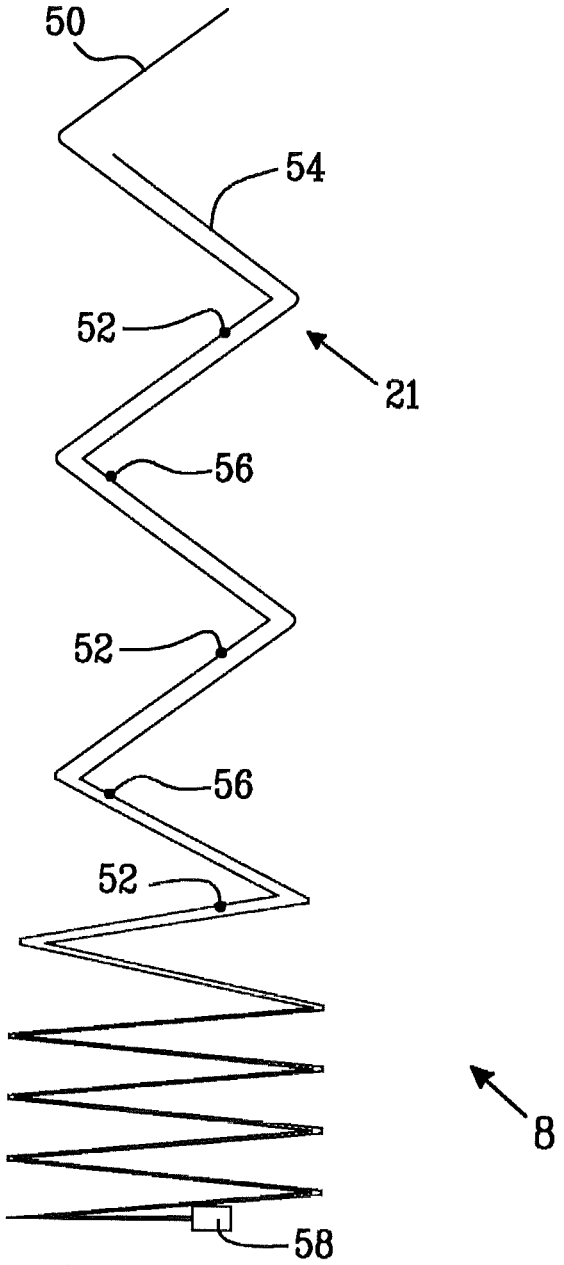
FIG. 4 illustrates schematically a cross section through a stack of web material according to embodiments.

FIG. 4 illustrates schematically a cross section through a stack 8 of web material according to embodiments. The stack 8 is adapted for being placed in a stack position 10 of a dispenser 2 according to any one of FIG. 1, or 2 and 3. A tail 21 of web material from the stack 8 is threaded along a web path of a relevant dispenser 2. The web material in the stack 8 of web material is a continuous web material which is Z-folded in an accordion-like manner. The web material comprise a first web layer 50 divided into sheet products defined between longitudinally separated lines of weakness 52 extending across the first web layer 50. The web material further comprise at least one second web layer 54 divided into sheet products defined between longitudinally separated lines of weakness 56 extending across the second web layer 54. The first and second web layers 50, 54 are interfolded so that the lines of weakness 52 of the first web layer 50 are offset from the lines of weakness 56 of the second web layer 56 in a longitudinal direction of the first web layer 50. At one end or at both ends of the stack 8, the stack 8 may be provided with an adhesion arrangement 58 for interconnecting the web material of one stack 8 with that of a further stack 8. Thus, replenishing a dispenser 2 with stacks 8 of web material may be facilitated.

Example embodiments described above may be combined as understood by a person skilled in the art. It is also understood by those skilled in the art that the dispenser may be used with a stack of non-perforated web material, in which case a separation unit comprising a cutting element may be provided in the dispenser. The cutting element may for instance be a cutting knife, a rotating cutting cylinder, or a serrated edge.

Although the invention has been described with reference to example embodiments, many different alterations, modifications and the like will become apparent for those skilled in the art. For instance, each one of the first and second layers of the web material may comprise one or more sub-layers. The sub-layers may be at least partially connected to each other. The web material in a stack of continuous web material may be V-folded or W-folded in an accordion-like manner.

Therefore, it is to be understood that the foregoing is illustrative of various example embodiments and that the invention is defined only the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A dispenser for dispensing at least one web from a stack of web material, the dispenser comprising:

a housing arranged to hold a stack of web material, wherein a web path extends in an interior of the housing from a stack position to a dispensing opening of the dispenser, the web path extending in a first direction in a first portion of the housing and in a second direction in a second portion of the housing, the first and second directions being directed in substantially opposite directions, and wherein the housing comprises:

an access opening in a first side portion of the housing, the access opening providing access to the interior of the housing, wherein the web path is accessible along a third direction, in both the first and second portions of the housing, via the access opening.

2. The dispenser according to claim 1, wherein the third direction is substantially perpendicular to at least one of the first and second directions.

3. The dispenser according to claim 1, wherein the web path is accessible at a level defined between a first support element for the web material and a second support element for the web material, in both the first and second portions of the housing, via the access opening.

4. The dispenser according to claim 1, wherein the housing comprises a door arranged to open and close the access opening.

5. The dispenser according to claim 1, wherein the first portion of the housing, seen in a direction from the access opening, is arranged after the second portion of the housing.

6. The dispenser according to claim 1, wherein the first portion of the housing is arranged adjacent to a first wall of the housing, the first wall being arranged opposite to the access opening.

7. The dispenser according to claim 1, wherein the second portion of the housing is arranged adjacent to the access opening.

8. The dispenser according to claim 1, wherein the dispenser comprises a stack of web material arranged in the stack position inside the dispenser.

9. The dispenser according to claim 3, wherein the first direction extends from the stack position to the first support element, and the second direction extends from the first support element to the second support element.

10. The dispenser according to claim 3, wherein the web path extends over the first support element.

11. The dispenser according to claim 3, wherein the second support element comprises a separation unit adapted for separating a sheet of web from a tail of a web material coming from a stack of web material.

12. The dispenser according to claim 3, wherein the first support element comprises a third roller pivotably suspended inside the housing.

13. The dispenser according to claim 4, wherein the dispensing opening is arranged in the door.

14. The dispenser according to claim 6, wherein a guiding element is pivotably arranged inside the housing and arranged to pivot towards the first support element.

15. The dispenser according to claim 14, wherein the guiding element extends substantially from the first wall of the dispenser to the first support element.

16. The dispenser according to claim 11, wherein the separation unit comprises a first roller having a first rotation axis and a second roller having a second rotation axis, the first and second rotation axes extending in parallel with each other.

17. The dispenser according to claim 16, wherein each of the first and second rollers is provided with protrusion elements being spaced along the first and second rotation axes, and wherein outer portions of the protrusion elements on the first roller overlap partially with outer portions of the protrusion elements on the second roller with a radial overlap length forming an undulated passage for a web material between the first and second rollers.

18. The dispenser according to claim 17, wherein the radial overlap length is between 2-40 mm.

19. The dispenser according to claim 17, wherein each protrusion element has a widest width in parallel with the first and second axes within the overlap length, and a sum of the widest width of all protrusion elements on one of the first roller or the second roller is between 5-30% of a web width of that roller.

20. The dispenser according to claim 8, wherein the web material comprises a first web layer divided into sheet products defined between longitudinally separated lines of weakness extending across the first web layer.

21. The dispenser according to claim 20, wherein the web material comprises at least a second web layer divided into sheet products defined between longitudinally separated lines of weakness extending across the second web layer, and wherein the first and second web layers are interfolded so that the lines of weakness of the first web layer are offset from the lines of weakness of the second web layer in a longitudinal direction of the first web layer.

22. A dispenser for dispensing at least one web from a stack of web material, the dispenser comprising:

a housing arranged to hold a stack of web material, wherein a web path extends in an interior of the housing from a stack position to a dispensing opening of the dispenser, the web path extending in a first direction in a first portion of the housing and in a second direction in a second portion of the housing, the first and second directions being directed in substantially opposite directions, and wherein the housing comprises:

an access opening in a first side portion of the housing, the access opening providing access to the interior of the housing, wherein the web path is accessible at a level defined between a first support element for the web material and a second support element for the web material, in both the first and second portions of the housing, via the access opening.

23. The dispenser according to claim 22, wherein the first direction extends from the stack position to the first support element, and the second direction extends from the first support element to the second support element.

24. The dispenser according to claim 22, wherein the housing comprises a door arranged to open and close the access opening.

25. The dispenser according to claim 22, wherein the first portion of the housing, seen in a direction from the access opening, is arranged after the second portion of the housing.

26. The dispenser according to claim 22, wherein the first portion of the housing is arranged adjacent to a first wall of the housing, the first wall being arranged opposite to the access opening.

27. The dispenser according to claim 22, wherein the second portion of the housing is arranged adjacent to the access opening.

28. The dispenser according to claim 22, wherein the web path extends over the first support element.

29. The dispenser according to claim 22, wherein the second support element comprises a separation unit adapted for separating a sheet of web from a tail of a web material coming from a stack of web material.

30. The dispenser according to claim 22, wherein the first support element comprises a third roller pivotably suspended inside the housing.

31. The dispenser according to claim 22, wherein the dispenser comprises a stack of web material arranged in the stack position inside the dispenser.

32. The dispenser according to claim 24, wherein the dispensing opening is arranged in the door.

33. The dispenser according to claim 26, wherein a guiding element is pivotably arranged inside the housing and arranged to pivot towards the first support element.

34. The dispenser according to claim 33, wherein the guiding element extends substantially from the first wall of the dispenser to the first support element.

35. The dispenser according to claim 29, wherein the separation unit comprises a first roller having a first rotation axis and a second roller having a second rotation axis, the first and second rotation axes extending in parallel with each other.

36. The dispenser according to claim 35, wherein each of the first and second rollers is provided with protrusion elements being spaced along the first and second rotation axes, and wherein outer portions of the protrusion elements on the first roller overlap partially with outer portions of the protrusion elements on the second roller with a radial overlap length forming an undulated passage for a web material between the first and second rollers.

37. The dispenser according to claim 36, wherein the radial overlap length is between 2-40 mm.

38. The dispenser according to claim 36, wherein each protrusion element has a widest width in parallel with the first and second axes within the overlap length, and a sum of the widest width of all protrusion elements on one of the first roller or the second roller is between 5-30% of a web width of that roller.

39. The dispenser according to claim 31, wherein the web material comprises a first web layer divided into sheet products defined between longitudinally separated lines of weakness extending across the first web layer.

40. The dispenser according to claim 39, wherein the web material comprises at least a second web layer divided into sheet products defined between longitudinally separated lines of weakness extending across the second web layer, and wherein the first and second web layers are interfolded so that the lines of weakness of the first web layer are offset from the lines of weakness of the second web layer in a longitudinal direction of the first web layer.

* * * * *